US009157458B2

(12) United States Patent
Kubo et al.

(10) Patent No.: US 9,157,458 B2
(45) Date of Patent: Oct. 13, 2015

(54) AIR BLOWING DEVICE AND AIR BLOWING METHOD

(71) Applicant: Sharp Kabushiki Kaisha, Osaka-shi, Osaka (JP)

(72) Inventors: Hiroaki Kubo, Osaka (JP); Yasuhiro Nunotani, Osaka (JP); Katsushi Morimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/370,808

(22) PCT Filed: Nov. 29, 2012

(86) PCT No.: PCT/JP2012/080814
§ 371 (c)(1),
(2) Date: Jul. 7, 2014

(87) PCT Pub. No.: WO2013/105352
PCT Pub. Date: Jul. 18, 2013

(65) Prior Publication Data

US 2015/0136997 A1 May 21, 2015

(30) Foreign Application Priority Data

Jan. 11, 2012 (JP) ..... 2012-002970

(51) Int. Cl.

| | |
|---|---|
| ***F04F 5/16*** | (2006.01) |
| ***F04D 25/08*** | (2006.01) |
| ***F04F 5/46*** | (2006.01) |
| ***H01J 27/02*** | (2006.01) |

(52) U.S. Cl.
CPC . *F04F 5/16* (2013.01); *F04D 25/08* (2013.01); *F04F 5/46* (2013.01); *H01J 27/022* (2013.01)

(58) Field of Classification Search
USPC ..... 250/423 R, 424
See application file for complete search history.

(56) References Cited

U.S. PATENT DOCUMENTS

| | | | | |
|---|---|---|---|---|
| 2010/0015905 | A1* | 1/2010 | Hu | 454/258 |
| 2010/0150699 | A1 | 6/2010 | Nicolas et al. | |

FOREIGN PATENT DOCUMENTS

| | | | |
|---|---|---|---|
| JP | 56-88987 | U | 7/1981 |
| JP | 56-167897 | A | 12/1981 |
| JP | 60-101441 | A | 6/1985 |
| JP | 64-21300 | U | 2/1989 |
| JP | 02-185696 | A | 7/1990 |
| JP | 3091200 | U | 1/2003 |
| JP | 2010-138906 | A | 6/2010 |
| JP | 2013-015114 | A | 1/2013 |

OTHER PUBLICATIONS

Official Communication issued in International Patent Application No. PCT/JP2012/080814, mailed on Mar. 5, 2013.

* cited by examiner

*Primary Examiner* — Kiet T Nguyen
(74) *Attorney, Agent, or Firm* — Keating & Bennett, LLP

(57) ABSTRACT

An air blowing device 1 includes: a main body housing 2 to open a suction inlet 4*a* and a jet outlet 5*a* of an air; and an air blower 3 to be provided in a lower portion in the main body housing 2 and to circulate the air that is sucked from the suction inlet 4*a* towards the jet outlet 5*a*. The main body housing 2 is in a column shape from below to above, and the jet outlet 5*a* is formed in a slit shape in a vertically long rectangular shape along a side wall of the main body housing 2 and also is arranged to expel an air in an approximately transverse direction.

9 Claims, 7 Drawing Sheets

AIR BLOWING DEVICE AND AIR BLOWING METHOD

TECHNICAL FIELD

The present invention relates to an air blowing device and an air blowing method to generate an air flow.

BACKGROUND ART

An electric fan, which is an air blowing device for domestic use, is to generate an air flow by driving a propeller fan with a motor and widely spread because of the structural simplicity and the inexpensiveness. In recent years, air blowing devices having a fan invisible from outside are spread, and related art is disclosed in PTLs 1 through 3.

In the electric fan described in PTL 1, an air outlet in a slit shape elongated in a longitudinal direction is formed in a side wall of a main box body that is formed vertically, and two sirocco fans are arranged immediately inside the outlet that are provided in vertical alignment. By driving a motor arranged between the two sirocco fans, the fans rotate and the air is expelled from the outlet in a slit shape towards a transverse direction.

The air blower and the electric fan described in PTLs 2 and 3 are provided with an air jet nozzle (air expelling ring) formed in a ring shape in an upper portion of a main body that stores a fan and a motor. By driving the motor arranged in a lower portion of the main body, the fan rotates and the air is expelled from the jet nozzle in a ring shape towards a transverse direction.

CITATION LIST

Patent Literature

PTL 1: Japanese Unexamined Patent Application Publication No. 2-185696

PTL 2: Japanese Unexamined Patent Application Publication No. 2010-138906

PTL 3: Japanese Unexamined Patent Application Publication No. 56-167897

SUMMARY OF INVENTION

Technical Problem

However, since the electric fan described in PTL 1 has the sirocco fans arranged immediately inside the air outlet in the side wall of the main body, the size of the main body around the outlet becomes a size including the fan. Accordingly, there used to be a problem that the outer shape of the main body around the outlet, that is, the installation area of the electric fan becomes relatively large. Further, there is a concern that heavy loads, such as sirocco fans and a motor, are arranged in relatively high positions of the vertically long box, so that the weight balance of the main body is unstable.

The air blower and the electric fan described in PTLs 2 and 3 have an air jet nozzle in a ring shape, which is equivalent to a form similar to a conventional electric fan having a propeller fan. Accordingly, there used to be a problem that the outer shape of the main body surrounding the jet nozzle, that is, the installation area of the electric fan becomes relatively large.

The present invention has made in view of the above issues, and it is an object thereof to provide a space saving air blowing device. It is also an object thereof to provide an air blowing method capable of generating an air flow in the space saving occupied area.

Solution to Problem

To solve the above problems, an air blowing device of the present invention includes: a main body housing to open a suction inlet and a jet outlet of an air; and an air blower to be provided in a lower portion in the main body housing and to circulate the air that is sucked from the suction inlet towards the jet outlet, wherein the main body housing is in a column shape from below to above, and the jet outlet is formed in a slit shape in a vertically long rectangular shape along a side wall of the main body housing and also is arranged at least in part thereof to expel an air in an approximately transverse direction.

According to the configuration, an air circulates inside the main body housing from the suction inlet to the jet outlet by driving the air blower. The air sucked in the main body housing is expelled from the jet outlet in the side wall of the main body housing in a column shape from below to above. Since the main body housing is in a column shape from below to above and also the air blower is not arranged immediately inside the jet outlet, the air blowing device has an outer shape very compact.

In the air blowing device in the above configuration, the main body housing has an approximately horizontal cross-sectional outer shape in a place to open the jet outlet of a streamline shape, and the jet outlet is arranged in a place corresponding to a downstream end of the streamline shape.

According to the configuration, the air flow expelled from the jet outlet induces movement of the air in the vicinity of an outer surface of the main body housing. In the vicinity of the outer surface of the main body housing surrounding the jet outlet, an air flow along a direction of expelling the air from the jet outlet is generated. The air expelled by the air blowing device increases.

The "streamline shape" here is a shape to reduce air resistance and means a shape configured with curves not to generate a vortex in the surroundings when placed in a flow and to minimize resistance received from the flow. The "streamline shape" is generally an elongated shape along the air flow direction, and has the upstream end of the flow being round and the downstream end being sharp. From a place corresponding to the downstream end of the streamline shape, which is the outer shape of the cross-section of the main body housing, the jet outlet expels an air towards the downstream side of the air flow generated in the vicinity of the outer surface of the main body housing.

In the air blowing device in the above configuration, the main body housing has the cross-sectional shape in the place to open the jet outlet of a spindle shape.

In the air blowing device in the above configuration, the main body housing has the cross-sectional shape in the place to open the jet outlet of a cross-sectional shape of a wing.

According to the configurations, it becomes easier that the air flow expelled from the jet outlet induces movement of the air in the vicinity of an outer surface of the main body housing. In the vicinity of the outer surface of the main body housing surrounding the jet outlet, it becomes easier to generate an air flow along a direction of expelling the air from the jet outlet. The air expelled by the air blowing device increases even more.

In the air blowing device in the above configuration, the jet outlet is curved to have an air expelling direction directed upward from a lower end to an upper end. According to the configuration, the air is expelled from the transverse direction of the main body housing to the slightly upward direction. The air blowing device expels an air in a wide region.

In the air blowing device in the above configuration, an ion generation device to emit an ion in an air in the main body housing is provided. According to the configuration, the air containing ions is sent from the jet outlet of the main body housing to outside.

In the air blowing device in the above configuration, a displacement device to move an air expelling direction from the jet outlet in a transverse direction is provided. According to the configuration, an air is expelled in a wide region in the transverse direction of the main body housing.

In addition, in order to solve the problems above, an air blowing method of the present invention includes expelling an air sucked from a suction inlet into a main body housing to a jet outlet by driving an air blower provided inside the main body housing, wherein the air is expelled from the jet outlet formed in a vertically long rectangular slit shape arranged along a side wall of the main body housing in a column shape from below to above in an approximately transverse direction.

According to the configuration, by driving the air blower, the air circulates inside the main body housing from the suction inlet to the jet outlet. The air sucked in the main body housing is expelled from the jet outlet in the side wall of the main body housing in a column shape from below to above.

In the air blowing method of the above configuration, the air is expelled from the jet outlet while moving the jet outlet in a transverse direction. According to the method, an air is expelled in a wide region in the transverse direction of the main body housing.

Advantageous Effects of Invention

According to the configuration of the present invention, the air blowing device expels an air from a jet outlet in a side wall of a main body housing in a column shape from below to above. It is thus possible to provide a space saving air blowing device. It is also possible to provide an air blowing method capable of generating an air flow in a space saving occupied area.

DESCRIPTION OF EMBODIMENTS

Descriptions are given below to an air blowing device according to an embodiment of the present invention based on FIG. 1 through FIG. 9.

Figure 1:
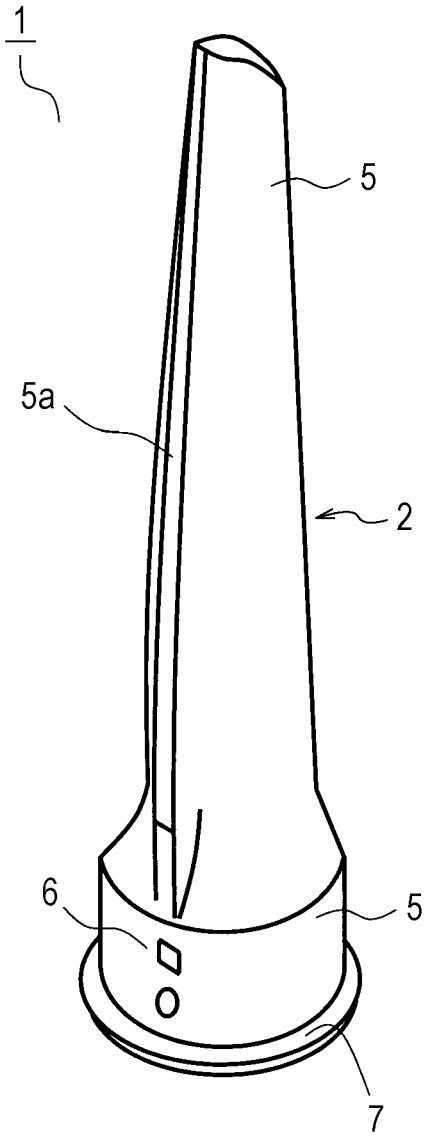
FIG. 1 is an external perspective view of an air blowing device according to an embodiment of the present invention.
Figure 2:
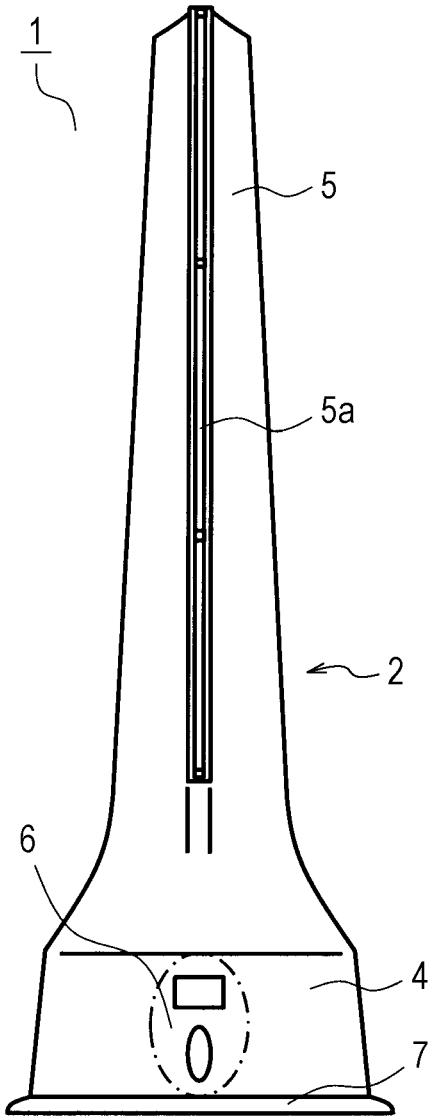
FIG. 2 is a front view of an air blowing device according to an embodiment of the present invention.
Figure 3:
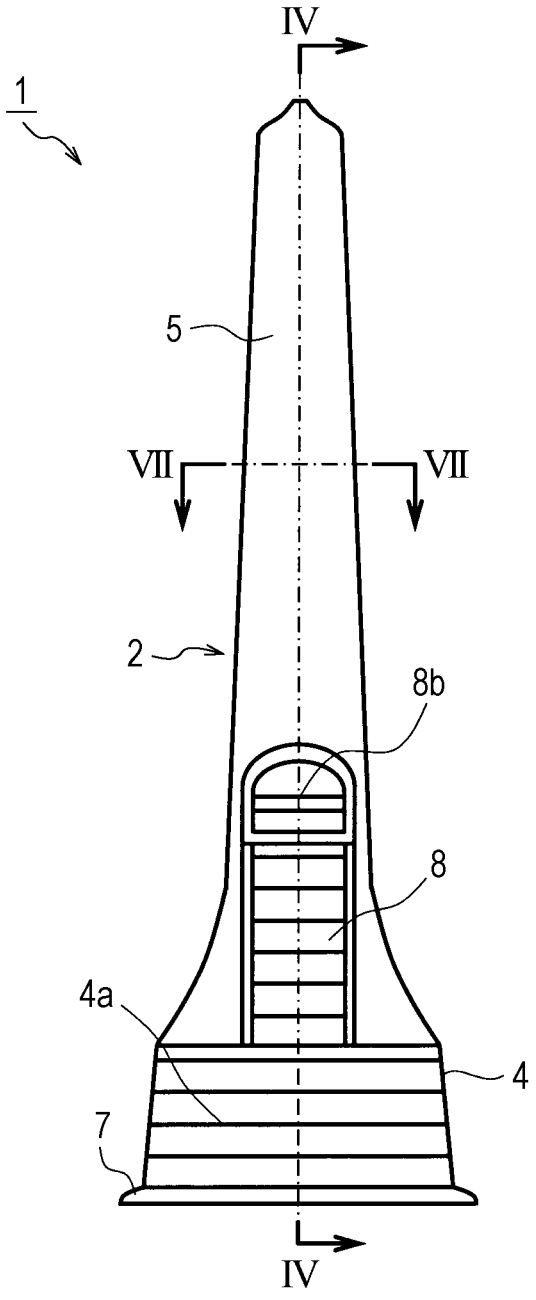
FIG. 3 is a back view of an air blowing device according to an embodiment of the present invention.
Figure 4:
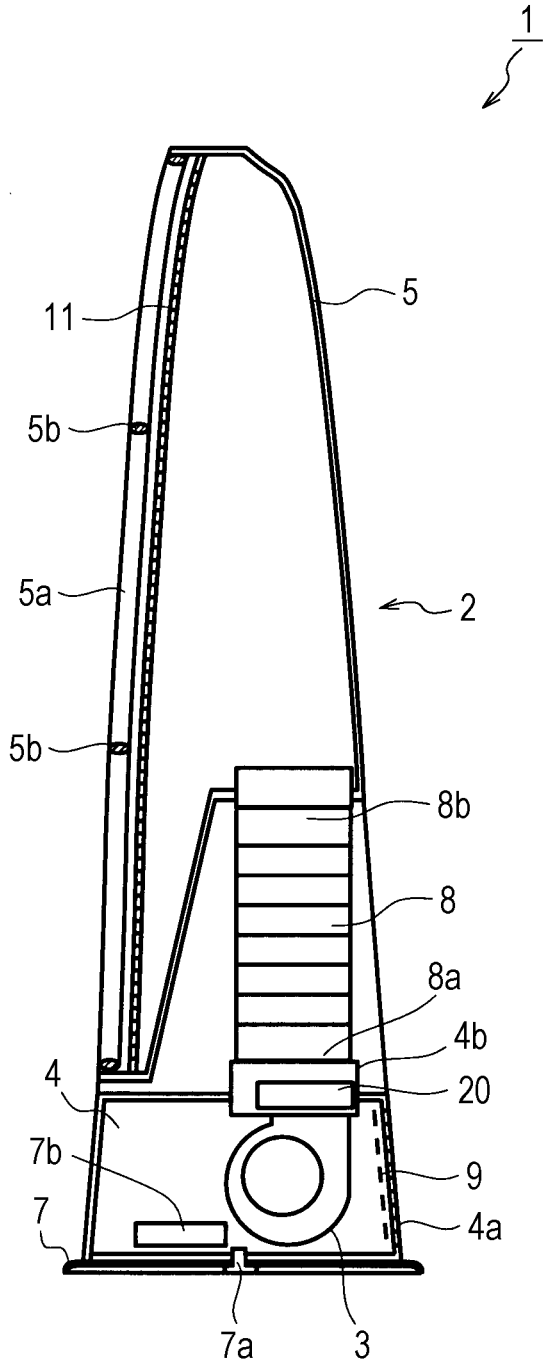
FIG. 4 is a vertical cross-sectional view of the air blowing device illustrated in FIG. 3 taken on line IV-IV.

Firstly, an outline of a structure of an air blowing device according to an embodiment of the present invention is described using FIG. 1 through FIG. 4. FIG. 1 is an external perspective view of the air blowing device, FIG. 2 is a front view of the air blowing device, FIG. 3 is a back view of the air blowing device, and FIG. 4 is a vertical cross-sectional view of the air blowing device illustrated in FIG. 3 taken on line IV-IV.

An air blowing device 1 is provided with a main body housing 2 in a column shape as illustrated in FIG. 1 through FIG. 4 and an air blower 3 provided inside the main body housing 2.

The main body housing 2 is installed upright on an installation surface in a column shape that is gradually tapered from below to above. The main body housing 2 is provided with a suction portion 4 in the lower portion to open a suction inlet 4*a* and provided with an expelling portion 5 in the upper portion to open a jet outlet 5*a*.

The main body housing 2 is provided with an operation portion 6 in the lower front portion. The main body housing 2 is provided with a circular seat portion 7 that has the main body housing 2 placed on the upper surface in the lowest portion to support it.

The air blower 3 is provided on the back surface side of the main body housing 2 and in the suction portion 4 in the lower portion. The suction portion 4 and the expelling portion 5 are connected with a flexible duct 8 extended from the air blower 3, which allows circulation of the air. Then, the air blower 3 circulates the air sucked from the suction inlet 4*a* towards the jet outlet 5*a*.

In a place of an exhaust outlet, not shown, of the air blower 3 and between the air blower 3 and the flexible duct 8, an ion generation device 20 is arranged. Inside the main body housing 2, a control board, not shown, is provided. The air blowing device 1 is also provided with a battery or a power supply plug, not shown, and receives power supply from the battery or a commercial alternative current power source for operation.

Figure 5:
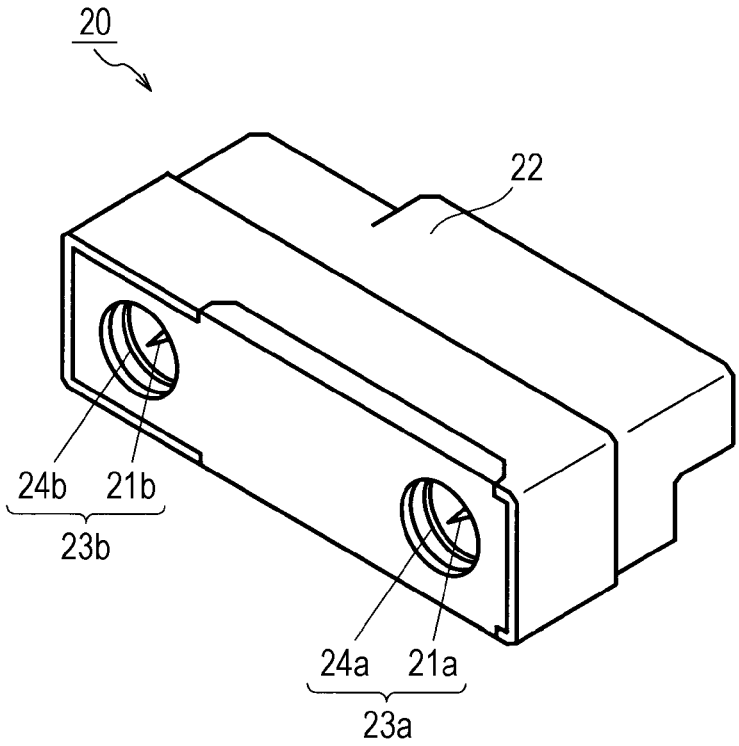
FIG. 5 is an external perspective view of an ion generation device of an air blowing device according to an embodiment of the present invention.
Figure 6:
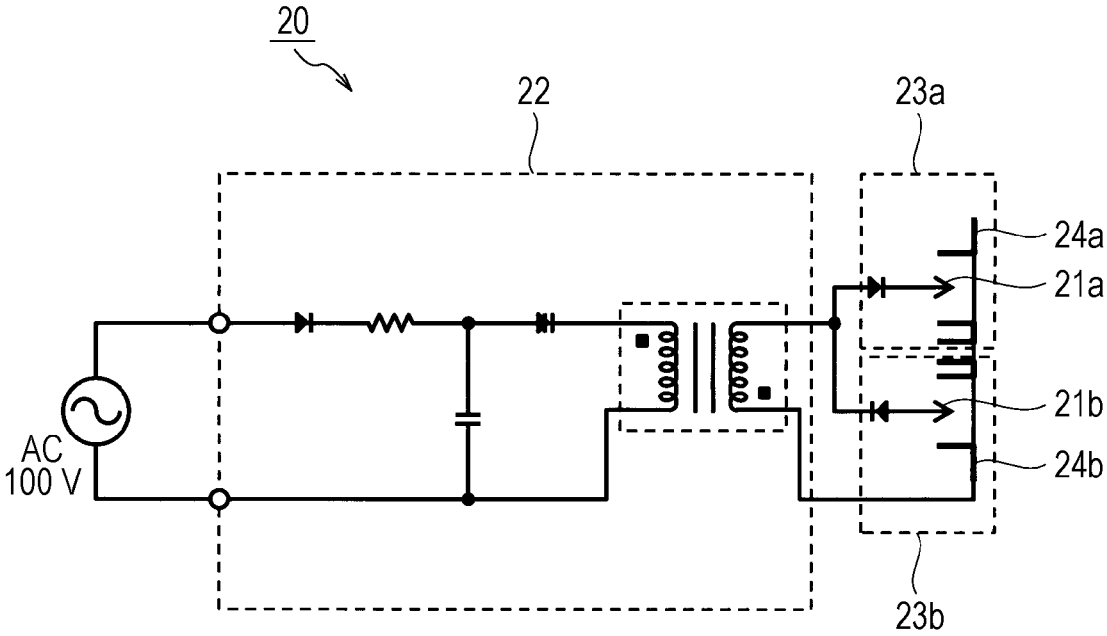
FIG. 6 is a circuit diagram of an ion generation device of an air blowing device according to an embodiment of the present invention.
Figure 7:
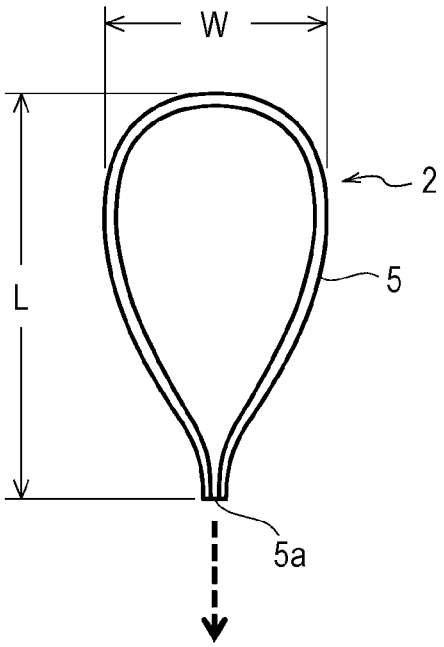
FIG. 7 is a cross-sectional view of the air blowing device illustrated in FIG. 3 taken on line VII-VII.
Figure 8:
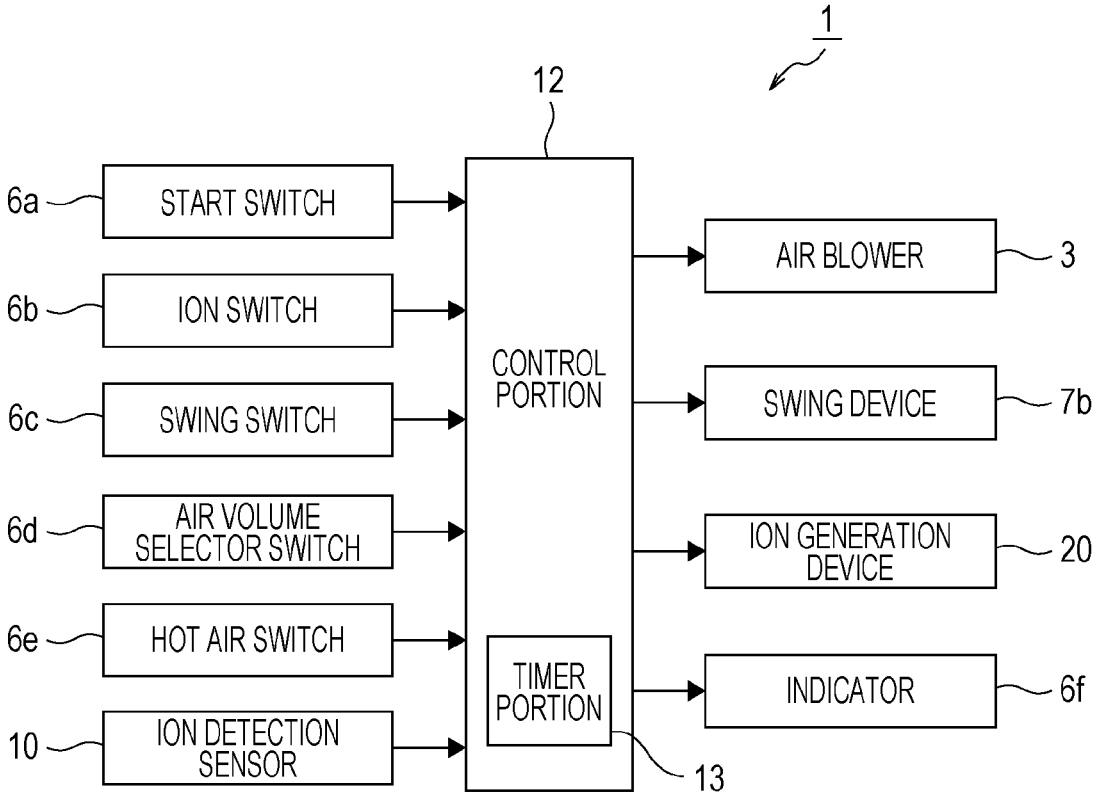
FIG. 8 is a block diagram illustrating an air blowing device according to an embodiment of the present invention.
Figure 9:
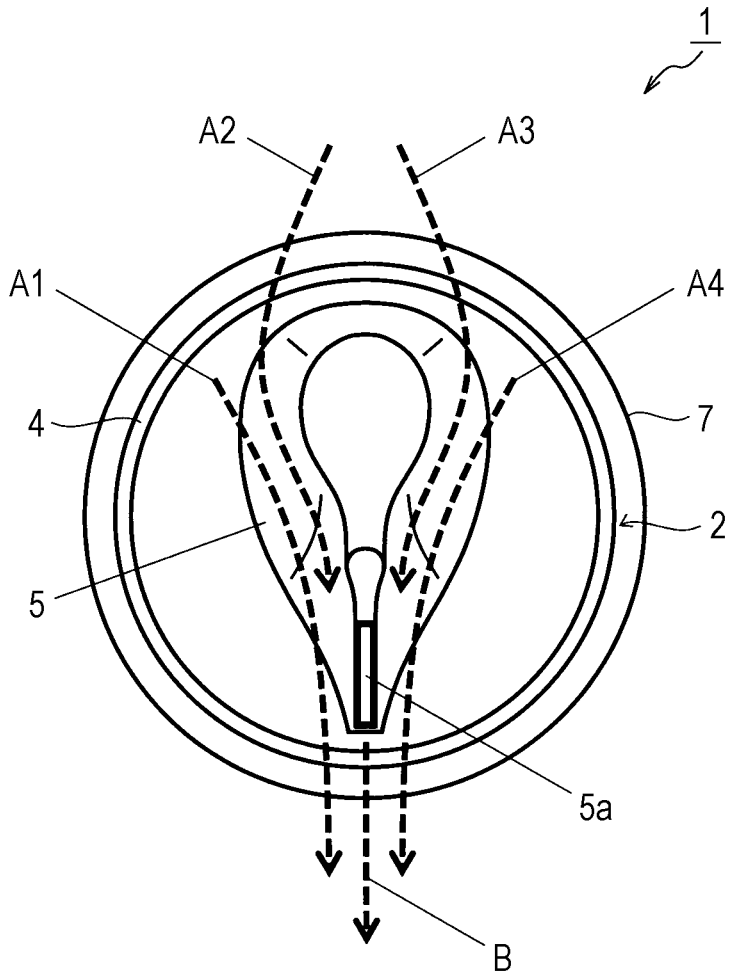
FIG. 9 is a schematic diagram illustrating an air flow when an air blowing device according to an embodiment of the present invention is operated.

Subsequently, a detailed configuration of the air blowing device 1 is described using FIG. 5 through FIG. 9 in addition to FIG. 1 through FIG. 4. FIG. 5 is an external perspective view of the ion generation device 20, FIG. 6 is a circuit diagram of the ion generation device 20, FIG. 7 is a cross-sectional view of the air blowing device 1 illustrated in FIG. 3 taken on line VII-VII, FIG. 8 is a block diagram illustrating a configuration of the air blowing device 1, and FIG. 9 is a schematic diagram illustrating an air flow when the air blowing device 1 is operated.

The suction portion 4 of the main body housing 2 is provided in a lower portion of the main body housing 2 as illustrated in FIG. 3 and FIG. 4 and is configured in a cylindrical shape having an approximately horizontal cross-section in a circular shape. The suction portion 4 contains a space as an air passage inside and is provided with the suction inlet 4*a* in the back surface. The suction inlet 4*a* opens in a radial direction to communicate inside and outside of the suction portion 4. Immediately inside the suction inlet 4*a*, a net filter 9 to collect dust contained in the sucked air is installed.

The operation portion 6 is provided in a front surface of the suction portion 4. The operation portion 6 is provided with switches, such as a start switch 6*a*, an ion switch 6*b*, a swing switch 6*c*, an air volume selector switch 6*d*, and a hot air switch 6*e*, that are illustrated in FIG. 8 and also provided with an indicator 6*f* to indicate operational information. The indicator 6*f* is configured with, for example, a small multi-color LED lamp and may also indicate detailed operational information using a liquid crystal screen or the like.

The seat portion 7 is provided in a lower portion of the suction portion 4 and in the lowest portion of the main body housing 2. The seat portion 7 is provided to enable a swing motion of the air blowing device 1. The seat portion 7 inserts a rotation shaft 7*a* thereof into a center in the radial direction of a bottom surface of the main body housing 2 as illustrated in FIG. 4 to support the main body housing 2 rotatably.

A swing device 7*b*, which is a displacement device that enables a swing motion of the air blowing device 1 using the seat portion 7, is provided inside the suction portion 4. The swing device 7*b* is, for example, a gear motor with a cam and converts a rotation operation to a reciprocating motion to achieve a swing motion that repeatedly turns main body housing 2 to left and right about the rotation shaft 7*a*.

The air blower 3 is configured with, for example, a sirocco fan and provided inside the suction portion 4 as illustrated in FIG. 4. The air blower 3 has a suction inlet, not shown, facing the air passage of the suction portion 4 and an exhaust outlet, not shown, connected to a connection portion 4*b* provided in a ceiling portion of the suction portion 4. The flexible duct 8 is connected to the connection portion 4*b*, and as the air blower 3 is driven, the ambient air sucked from the suction inlet 4*a* is circulated in the suction portion 4 to be sent out via the flexible duct 8 towards the expelling portion 5. Although the air blower 3 is described as a sirocco fan in the present embodiment, it may also be an air blower of a propeller fan or turbofan type.

The ion generation device 20 is arranged in a place of the connection portion 4*b* in the suction portion 4, that is, on a downstream side in an air communication direction relative to the air blower 3. The ion generation device 20 has a discharge electrode 21 used for discharge to emit ions and other electronic components provided in a housing and packaged as illustrated in FIG. 5, for example. The ion generation device 20 has a pair of discharge electrodes 21*a*, 21*b* facing the air passage for emission containing the ions generated by discharge with the discharge electrodes 21*a*, 21*b* in the air circulated in the connection portion 4*b*.

The ion generation device 20 is configured with a circuit illustrated in FIG. 6, for example. The ion generation device 20 is provided with a circuit portion 22 and ion generators 23*a*, 23*b*. The circuit portion 22 is provided with a high voltage power generation circuit that receives power supply from outside to produce a high voltage electrical pulse.

The ion generator 23*a* is provided with the discharge electrode 21*a* and an induction electrode 24*a*, and the ion generator 23*b* is provided with the discharge electrode 21*b* and an induction electrode 24*b*. The discharge electrodes 21*a*, 21*b* are formed in a needle shape, respectively, and arranged in alignment at a predetermined interval. The induction electrode 24*a* is formed in a ring shape taking the discharge electrode 21*a* as the center and faces the discharge electrode 21*a*. Similarly, the induction electrode 24*b* is formed in a ring shape taking the discharge electrode 21*b* as the center and faces the discharge electrode 21*b*.

The ion generators 23*a*, 23*b* have a same structure, and a high voltage produced in the high voltage power generation circuit is supplied to the respective discharge electrodes 21*a*, 21*b*, which generates discharge with the respective induction electrodes 24*a*, 24*b* to emit ions.

Here, to the discharge electrodes 21*a*, 21*b* of the ion generation device 20, a voltage of an alternating waveform or an impulse waveform is applied. A positive voltage is applied to the discharge electrode 21*a*, and a hydrogen ion by corona discharge is bound to moisture in the air to generate a positive ion mainly of $H^+(H_2O)m$. A negative voltage is applied to the discharge electrode 21*b*, and an oxygen ion by corona discharge is bound to moisture in the air to generate a negative ion mainly of $O_2^-(H_2O)n$. Here, m and n are arbitrary natural numbers. $H^+(H_2O)m$ and $O_2^-(H_2O)n$ aggregate on a surface of floating fungus and odor components in the air to surround them.

Then, as shown in formulae (1) through (3), [.OH] (hydroxyl radical) and $H_2O_2$ (hydrogen peroxide), which are active species, are aggregate produced on a surface of microbes or the like by collision to destroy the floating fungus and the odor components. Here, m' and n' are arbitrary natural numbers. Accordingly, by generating positive ions and negative ions to expel from the jet outlet 5*a*, it is possible to carry out, for example, sterilization and deodorization in a room.

$$H^+(H_2O)m+O_2^-(H_2O)n \rightarrow .OH+\tfrac{1}{2}O_2+(m+n)H_2O \quad (1)$$

$$H^+(H_2O)m+H^+(H_2O)m'+O_2^-(H_2O)n+O_2^-(H_2O)n' \rightarrow 2\cdot OH+O_2+(m+m'+n+n')H_2O \quad (2)$$

$$H^+(H_2O)m+H^+(H_2O)m'+O_2^-(H_2O)n+O_2^-(H_2O)n' \rightarrow H_2O_2+O_2+(m+m'+n+n')H_2O \quad (3)$$

Although a positive ion and a negative ion are generated by the ion generation device 20 in the present embodiment, only a positive ion or a negative ion may also be generated.

In the present invention, an ion may include charged fine particle water. At this time, the ion generation device 20 is made from an electrostatic atomization device, and charged fine particle water containing a radical component is produced by the electrostatic atomization device. That is, a discharge electrode provided in the electrostatic atomization device is cooled by a Peltier element, thereby generating dew condensation water on the surface of the discharge electrode. Next, as a negative high voltage is applied to the discharge electrode, charged fine particle water is produced from the dew condensation water. From the discharge electrode, negative ions emitted in the air are generated as well as the charged fine particle water.

On the downstream side in the air communication direction of the ion generation device 20, an ion detection sensor 10 is provided (refer to FIG. 8). The ion detection sensor 10 confirms generation of ions to monitor an operation situation of the ion generation device 20.

The flexible duct 8 forms an accordion fold and is arranged on the back surface side of the air blowing device 1 and in a place between the suction portion 4 and the expelling portion 5 as illustrated in FIG. 3 and FIG. 4. The flexible duct 8 is arranged in an approximately vertical position. This causes the air flow sent out from the air blower 3 to flow into the expelling portion 5 approximately parallel to a longitudinal direction of the expelling portion 5.

The flexible duct 8 has an upstream end 8*a* in the air communication direction connected to the connection portion 4*b* in the suction portion 4 and a downstream end 8*b* detachably connected to the expelling portion 5. In the flexible duct 8, the downstream end 8*b* may be removed from the expelling portion 5 to be drawn from the upstream end 8*a* for bending. Then, by drawing and attaching an accessory, not shown, to the downstream end 8*b* of the flexible duct 8, the air blowing device 1 may also be used in various applications.

There are, for example, two types of flexible duct 8 including a type less capable of changing the length from during storage to during use and a type capable of greatly changing the length. Either type may be employed for blowing air.

Those capable of changing the length, such as the flexible duct 8 of the air blowing device 1 of the present invention may be used in more applications.

The expelling portion 5 of the main body housing 2 is provided in the upper portion of the main body housing 2 as illustrated in FIG. 1, FIG. 2, and FIG. 4, and is in a column shape that is gradually tapered from below to above as described above. The expelling portion 5 contains a space as an air passage inside and is provided with the jet outlet 5*a* in the front surface. The jet outlet 5*a* is formed in a slit shape in a vertically long rectangular shape along a side wall of the main body housing 2 and also arranged in most part of the lower side thereof to expel an air in an approximately transverse direction.

Then, the jet outlet 5*a* is not vertical to the installation surface but is curved to have the air expelling direction directed upward taking from the lower end to the upper end. This causes the air blowing device 1 to expel an air forward and obliquely upward. The jet outlet 5*a* does not have to be curved to have the air expelling direction directed upward as taking from the lower end to the upper end, and may also be vertical to the installation surface.

The width and the length of the slit of the jet outlet 5*a* are determined by the air volume to be sent. For example, in the present embodiment, the slit width of the jet outlet 5*a* is approximately 8 mm. In order to pull the air around the jet outlet 5*a* by the air flow expelled from the jet outlet 5*a*, a faster air flow rate is advantageous, and the slit width is preferably 1 cm or less. On that basis, in order to handle various air volumes, when the air flow rate expelled from the jet outlet 5*a* is fixed, it is general to increase the length of the jet outlet 5*a* in an air blowing device for a large air volume and decrease the length of the jet outlet 5*a* in an air blowing device for a small air volume. In other words, the expelling portion 5 becomes longer for a large air volume and the expelling portion 5 becomes shorter for a small air volume. The jet outlet 5*a* is provided with spacer portions 5*b* in several points along the longitudinal direction to keep the slit width in a predetermined width.

Immediately inside the jet outlet 5*a*, a rectifier filter 11 to send an air uniformly from the jet outlet 5*a* is provided. The rectifier filter 11 is a structure provided with adequate air resistance as well as air permeability, and maintains inside the expelling portion 5 at an appropriate static pressure. In such a manner, a velocity energy of the air sent out from the air blower 3 is converted to a static pressure energy and also rectification of the sent air is carried out. By converting the velocity energy of the air sent out from the air blower 3 to a static pressure energy, the static pressure is applied uniformly inside a jet outlet portion 5. Since the static pressure acts in any place and vertically and uniformly to any surface, it is possible to expel an air uniformly along the longitudinal direction of the jet outlet 5*a*.

In addition, it is also possible to configure to obtain adequate air resistance by narrowing the width of the slit shape of the jet outlet 5*a*. In this case, the rectifier filter 11 may be omitted.

In the main body housing 2, the place to open the jet outlet 5*a* has an outer shape of an approximately horizontal cross-section in a streamline shape as illustrated in FIG. 7. The streamline shape is a shape to reduce the air resistance and is a shape configured with curves that does not generate a vortex in the surroundings when placed in a flow and creates least resistance received from the flow. The streamline shape is also an elongated shape along a flowing direction of the air flow assumed to be generated in the vicinity of an outer surface of the main body housing 2, and has the upstream end of the flow being round and the downstream end being sharp. The jet outlet 5*a* is arranged in a place corresponding to the downstream end of the streamline shape, which is the outer shape of the cross-section of the main body housing 2, and an air is expelled towards the downstream side of the air flow generated in the vicinity of the outer surface of the main body housing 2.

As illustrated in FIG. 7, when the length in the air expelling direction from the jet outlet 5*a* is L and the width in the direction perpendicular to the air expelling direction is W, the approximately horizontal cross-section in the place to open the jet outlet 5*a* of the main body housing 2 is configured to be W<L. The shape of an area in a side surface of the main body housing 2 connected to the jet outlet 5*a* is in a shape that does not disturb movement of the air around the jet outlet 5*a* to be pulled by the air flow expelled from the jet outlet 5*a*.

Here, the control board, not shown, provided in the main body housing 2 is provided with a control portion 12 configured with a CPU and other electronic components, not shown, to control operation of the air blowing device 1 (refer to FIG. 8). The control portion 12 controls components, such as the air blower 3, the ion generation device 20, and the swing device 7*b*, based on programs and data that are stored and inputted in a storage portion (not shown) utilizing the CPU as a central processing unit, thereby achieving a series of air blowing operation and ion sending operation. The control portion 12 is provided with a timer portion 13 and capable of measuring a variety of time taking the clock period of the system as reference.

When the start switch 6*a* of the operation portion 6 is operated in the air blowing device 1 of the above configuration to direct an air blowing operation, the air blower 3 and the ion generation device 20 are driven. This causes the main body housing 2 to suck the air outside the air blowing device 1 from the suction inlet 4*a*. The air sucked from the suction inlet 4*a* flows into the air blower 3 through the air passage inside the suction portion 4.

The air discharged from the air blower 3 contains ions emitted by the ion generation device 20 in the place of the connection portion 4*b* of the suction portion 4. The air flow containing ions flows into the flexible duct 8. The air passing through the flexible duct 8 flows into the expelling portion 5. Then, the air containing ions is expelled from the jet outlet 5*a* provided along the side wall of the main body housing 2 in an approximately transverse direction.

The ions emitted by the ion generation device 20 is detected by the ion detection sensor 10, and the control portion 12 confirms that the amount of ion reaches a prescribed value based on the output of the ion detection sensor 10. The detection of the amount of ion is to measure the amount of ion for a certain period of time when starting the air blowing device 1 or after a lapse of preset time. When the amount of ion is less than the prescribed value, the indicator 6*f* indicates or alarms that there is the disorder and the air blowing device 1 stops the operation.

The control portion 12 also monitors accumulated operation time of the ion generation device 20. When the accumulated operation time of the ion generation device 20 exceeds a time defined in advance, the indicator 6*f* indicates or alarms that the life of the ion generation device 20 is over and the air blowing device 1 stops the operation. In the air blowing device 1, when the life of the ion generation device 20 is over and replaced with a new ion generation device, the alarm is reset to restart regular operation.

Then, the air blowing device 1 is capable of performing an air blowing operation and an ion sending operation at the same time as described above, and also capable of independently performing an air blowing operation and an ion sending operation, respectively. It is preferred to selectably configure the operation of the ion generation device 20 for improvement of the convenience, and it is possible to turn on and off the ion sending operation with the ion switch 6*b* of the operation portion 6 (refer to FIG. 8). When a defect occurs in the ion generation device 20 or the life is over, it is possible to simply use an air blowing function only.

When the swing switch 6*c* of the operation portion 6 (refer to FIG. 8) is turned on, the swing device 7*b* starts a swing motion in accordance with the operation of the air blower 3. Here, since the air blowing device 1 has the jet outlet 5*a* in a vertically long slit shape, the air flow sent from the jet outlet 5*a* also becomes a vertically long zonal air flow. When the swing device 7*b* is not provided, for example, this causes the air flow to go only to an object in front of the jet outlet 5*a* to reduce the comfort. Accordingly, in order to diffuse an air flow and ions, the swing device 7*b* capable of a reciprocating motion in an adequate range is required.

The air flow sent from the jet outlet 5*a* of the air blowing device 1 in the present embodiment is very narrow in width and fast in rate, so that refreshing feelings are obtained when a person receives the air flow. Further, while the air blowing device 1 performs a swing motion, a strong vertically long linear air flow moves to scan the body surface from right to left or from left to right for even more refreshing feelings.

It is also preferred to allow modification of the air volume by varying the output of the air blower 3. The range of modifying the air volume is appropriately determined by the size of the jet outlet 5*a*. When the air volume is too much for the size of the jet outlet 5*a*, the expelled air flow rate becomes too fast, which causes generation of an unpleasant noise. On the contrary, when the air volume is too little, the outreach of the air flow is limited. Air volume modification means may be in accordance with the means practiced in many fields, and the operation portion 6 is provided with the air volume selector switch 6*d* (refer to FIG. 8).

It is also preferred to provide a heating device (not shown) of the air circulating in the main body housing 2 in the air communication path from the suction inlet 4*a* to the jet outlet 5*a*. In general, it is understood that an air temperature felt by a person, in other words, the effective temperature decreases by 1° C. as the wind speed of the air flow becomes faster at 1 m/s. In a case of the air temperature in a room at 20° C., when the wind speed of the air flow immediately after exiting the jet outlet 5*a* is 10 m/s, the effective temperature becomes around 10° C. and becomes close to a temperature of an air flow immediately after exiting a jet outlet of an air conditioner in summer. Therefore, it is preferred that a heating device of the air circulating inside the air blowing device 1 is provided not to let a user to feel chilly. It is possible to turn on and off the air heating operation with the hot air switch 6*e* of the operation portion 6 (refer to FIG. 8).

Then, FIG. 9 schematically illustrates an air flow surrounding the main body housing 2 when the air blowing device 1 is operated. The air blowing device 1 according to an embodiment of the present invention is characterized in a structure to expel an air and a shape of the expelling portion 5 (main body housing 2) having the jet outlet 5*a*.

Since the air blowing device 1 maintains a static pressure uniformly inside the expelling portion 5, a uniform air flow B of a laminar flow is sent from the jet outlet 5*a* across the entire region in the longitudinal directions (vertical directions) as illustrated in FIG. 9. Since the rate is relatively faster when the air flow B is sent from the jet outlet 5*a*, the pressure of the air flow B itself decreases in accordance with the Bernoulli's theorem to generate a contraction flow. This causes the air in the vicinity of the jet outlet 5*a* is drawn by the air flow B. As the air in the vicinity of the jet outlet 5*a* moves together with the air flow B, pulling of the surrounding air occurs continuously.

When the moving air flow pulled as such is the air flows A1, A4 illustrated in FIG. 9, an air is also pulled from the back side of the expelling portion 5 further by the air flows A1, A4 to start movement, which creates air flows A2, A3. The air flows A1 through A4, which are movements of the air surrounding the expelling portion 5 along the expelling portion 5, are stabilized as the time lapse and form a large air flow by being integrated with the air flow B expelled from the jet outlet 5*a*.

In other words, the expelling portion 5 exists as an obstacle in the air flow and in a situation to cut the air flow. Since the air flow passes along both sides of the expelling portion 5, it is preferred that the horizontal cross-sectional shape of the expelling portion 5 is in a less air resisting shape. Further, it is preferred that the shape is configured across the entire region of the jet outlet 5*a* in the longitudinal directions (vertical directions).

Generally, a shape suitable for an object to move in the air at a high speed is in a so-called streamline shape, such as a water drop shape or a cross-sectional shape of a wing, and a smaller frontal projected area of the obstacle taken from the upstream side of the air flow is better and a smaller shape factor of the tip end portion directly hit by the air flow is better. Further, it is preferred that the frontal projected area is smaller compared with the length of the obstacle in the air flow direction. Thus, in the present embodiment, the cross-section perpendicular to the longitudinal direction of the jet outlet 5*a*, that is, the horizontal cross-section is defined as the streamline shape.

Such a cross-sectional shape having less resistance in a fluid is generally called as a streamline shape or a spindle shape. The streamline shape and the spindle shape have less resistance to a high speed fluid in those having a length in a direction parallel to the fluid flow greater by several folds than the length in a direction perpendicular to the flow. The streamline shape and the spindle shape has a narrow shape in both ends on the upstream side and the downstream side along the streamline to reduce the resistance and has an expanded shape in the central portion along the streamline in a direction perpendicular to the streamline. Although the streamline shape and the spindle shape are different a little strictly, they may be used in a similar manner for reduction of resistance in a fluid. An example of the streamline shape and the spindle shape is a cross-sectional shape of a fish body, an aircraft wing, and the like. The approximately horizontal cross-sectional shape in the place to open the jet outlet 5*a* of the main body housing 2 is not limited to the spindle shape or the cross-sectional shape of a wing.

As described above, the air blowing device 1 has the main body housing 2 provided with the air blower 3 in the lower portion in a column shape that is gradually tapered from below to above and the jet outlet 5*a* formed in a vertically long rectangular slit shape along the side wall of the main body housing 2 and also expels an air in an approximately transverse direction. Since the main body housing 2 is in a column shape that is gradually tapered from below to above and the air blower 3 is not arranged immediately inside the jet outlet 5*a*, the air blowing device 1 may have an outer shape very compact, which makes it possible to reduce the occupied space of the main body housing 2. That is, the air blowing device 1 may be smaller than the occupied area when installed. In addition, since the air blower 3 is arranged in the lower portion of the main body housing 2, the air blowing device 1 is stable in weight balance and does not easily fall.

Since the main body housing 2 has the approximately horizontal cross-sectional outer shape in the place to open the jet outlet 5*a* being a streamline shape and the jet outlet 5*a* arranged in the place corresponding to the downstream end of the streamline shape, the air flow expelled from the jet outlet 5*a* induces movement of the air in the vicinity of the outer surface of the main body housing 2. Thus, it is possible to generate an air flow along the air expelling direction from the jet outlet 5*a* in the vicinity of the outer surface of the main body housing 2 surrounding the jet outlet 5*a*. Accordingly, it is possible to increase the air expelled by the air blowing device 1.

Then, since the main body housing 2 has the approximately horizontal cross-sectional outer shape in the place to open the jet outlet 5*a* of a spindle shape or a cross-sectional shape of a wing, the air flow expelled from the jet outlet 5*a* easily induces movement of the air in the vicinity of the outer surface of the main body housing 2. Thus, it is possible to easily generate an air flow along the air expelling direction from the jet outlet 5*a* in the vicinity of the outer surface of the main body housing 2 surrounding the jet outlet 5*a*. Accordingly, it is possible to increase the air expelled by the air blowing device 1 even more.

Since the jet outlet 5*a* is curved to have the air expelling direction directed upward from the lower end to the upper end, the air is expelled from the transverse direction of the main body housing 2 to a slightly upward direction. Thus, it becomes possible that the air blowing device 1 expels an air in a wide region.

Since the air blowing device 1 is provided with the ion generation device 20 to emit ions in the air in the main body housing 2, the air containing ions is sent from the jet outlet 5*a* of the main body housing 2 to outside. Thus, it is possible for the air blowing device 1 to perform, for example, sterilization and deodorization in a room.

Then, since the air blowing device 1 is provided with the swing device 7*b*, which is a displacement device to move the air expelling direction from the jet outlet 5*a* to a transverse direction, the air is expelled in a wide region in the transverse direction of the main body housing 2. By receiving the air flow thus flown in the transverse direction, it is possible for a user to obtain refreshing feelings even more to enhance the comfort.

Then, according to the configuration of the above embodiments of the present invention, it is possible to provide the space saving air blowing device 1. It is also possible to provide an air blowing method that is capable of generating an air flow in a space saving occupied area.

Although descriptions have been given above to embodiments of the present invention, the scope of the present invention is not limited to them and various modifications may be applied for execution without departing from the spirit of the invention.

INDUSTRIAL APPLICABILITY

The present invention is applicable in an air blowing device and an air blowing method to generate an air flow.

REFERENCE SIGNS LIST

1 air blowing device
2 main body housing
3 air blower
4*a* suction inlet
5*a* jet outlet
6 operation portion
7*b* swing device (displacement device)
12 control portion
20 ion generation device

The invention claimed is:

1. An air blowing device comprising:
a main body housing to open a suction inlet and a jet outlet of an air; and
an air blower to be provided in a lower portion in the main body housing and to circulate the air that is sucked from the suction inlet towards the jet outlet; wherein
the main body housing is in a column shape from below to above, and
the jet outlet is formed in a slit shape in a vertically long rectangular shape along a side wall of the main body housing and also is arranged at least in part thereof to expel an air in an approximately transverse direction.

2. The air blowing device according to claim 1, wherein
the main body housing has an approximately horizontal cross-sectional outer shape in a place to open the jet outlet of a streamline shape, and
the jet outlet is arranged in a place corresponding to a downstream end of the streamline shape.

3. The air blowing device according to claim 2, wherein the main body housing has the cross-sectional outer shape in the place to open the jet outlet of a spindle shape.

4. The air blowing device according to claim 2, wherein the main body housing has the cross-sectional outer shape in the place to open the jet outlet of a cross-sectional shape of a wing.

5. The air blowing device according to claim 1, wherein the jet outlet is curved to have an air expelling direction directed upward from a lower end to an upper end.

6. The air blowing device according to claim 1, comprising:
an ion generation device to emit an ion in an air in the main body housing.

7. The air blowing device according to claim 1, comprising:
a displacement device to move an air expelling direction from the jet outlet in a transverse direction.

8. An air blowing method comprising:
expelling an air sucked from a suction inlet into a main body housing to a jet outlet by driving an air blower provided inside the main body housing; wherein
the air is expelled from the jet outlet formed in a vertically long rectangular slit shape arranged along a side wall of the main body housing in a column shape from below to above in an approximately transverse direction.

9. The air blowing method according to claim 8, wherein the air is expelled from the jet outlet while moving the jet outlet in a transverse direction.

* * * * *